United States Patent [19]

Heinze et al.

[11] Patent Number: 4,658,265

[45] Date of Patent: Apr. 14, 1987

[54] FOLDABLE AND UNFOLDABLE ANTENNA REFLECTOR

[75] Inventors: Horst Heinze, Feldkirchen-Westerham; Henning Herbig, Holzkirchen, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 739,826

[22] Filed: May 31, 1985

[30] Foreign Application Priority Data

Jun. 26, 1984 [DE] Fed. Rep. of Germany ..... 3423526

[51] Int. Cl.[4] ..... H01Q 15/20

[52] U.S. Cl. ..... 343/915; 343/DIG. 2; 343/881

[58] Field of Search ..... 343/915, 840, 916, 912, 343/DIG. 2, 880, 881, 882; 244/173; 242/54 A

[56] References Cited

U.S. PATENT DOCUMENTS

| | | | |
|---|---|---|---|
| 3,496,687 | 2/1970 | Greenberg et al. | 343/915 |
| 3,503,072 | 3/1970 | Thompson | 343/915 |
| 3,525,483 | 8/1970 | VanAlstyne | 244/173 |
| 3,631,505 | 12/1971 | Carman | 343/915 |
| 3,699,581 | 10/1972 | Hall et al. | 343/915 |
| 3,717,879 | 2/1973 | Ganssle | 343/915 |
| 4,352,113 | 9/1982 | Labruyeré | 343/915 |
| 4,498,087 | 2/1985 | Imbiel et al. | 343/915 |
| 4,529,277 | 7/1985 | Gee et al. | 343/915 |

*Primary Examiner*—Charles Frankfort
*Assistant Examiner*—Thomas B. Will
*Attorney, Agent, or Firm*—W. G. Fasse; D. H. Kane, Jr.

[57] ABSTRACT

An antenna reflector, for example for a satellite or spacecraft, has ribs journalled to a central body by a first journal axis. Each rib has a radially inner section tiltable and lockable relative to the central body, and a radially outer section journalled to the inner rib section at a second journal axis for tilting and locking the outer rib section relative to the inner rib section. A motor driven cable drive and respective pulleys are so arranged that the inner rib sections are first partially unfolded before the outer rib sections begin to be unfolded. The outer rib sections then are moved faster than the inner rib sections so that both rib sections reach the fully unfolded state substantially simultaneously. The folding takes place in the reverse order, whereby the outer rib sections are folded first. The reflector netting is stretched out only after the ribs have been locked into the unfolded state.

7 Claims, 10 Drawing Figures

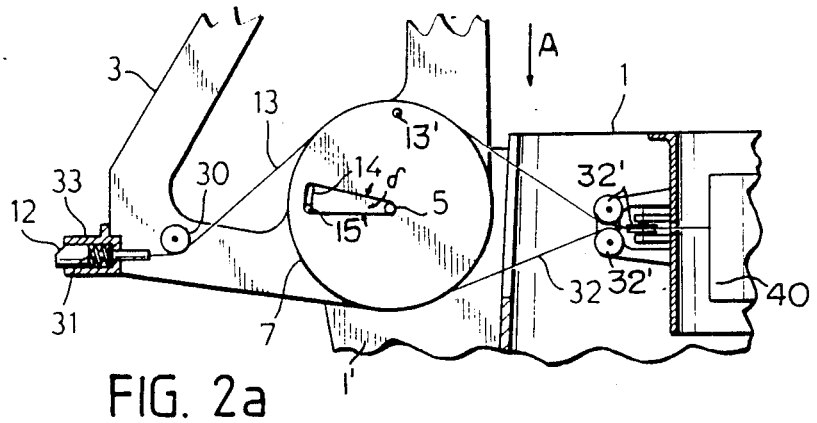
FIG. 2a
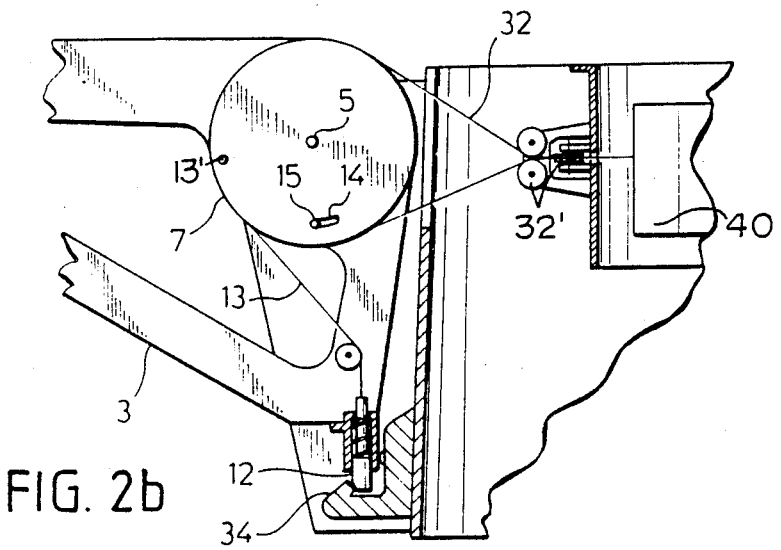
FIG. 2b
FIG. 2c
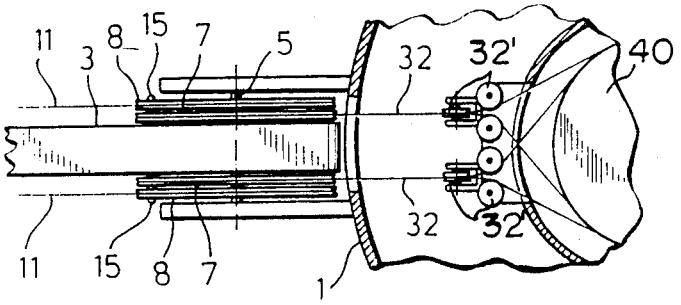

FOLDABLE AND UNFOLDABLE ANTENNA REFLECTOR

FIELD OF THE INVENTION

The invention relates to a foldable and unfoldable antenna reflector having a central mounting body and a plurality of folding ribs tiltably secured to the central body. The ribs are tiltable to extend radially away from the central mounting body. Each such rib comprises an inner rib section and an outer rib section. Each inner rib section is journalled to the mounting body and each outer rib section is journalled to the radially outer end of its respective inner rib section. The ribs carry a netting reflector and the folding and unfolding is accomplished by drive means mounted to the central body. The inner rib sections are tiltable through a first tilting angle range and the outer rib sections are tiltable through a second tilting angle range.

DESCRIPTION OF THE PRIOR ART

Antenna reflectors as described above are preferably used in astronautics where such antennas are employed by satellites or other spacecraft for communication purposes. During the transport to the intended orbit, it is necessary that such antenna reflectors are foldable into a space as small as possible. The antennas are unfolded only upon reaching the desired orbit or position, whereby the reflector netting secured to the tiltable ribs is stretched out and brought into the intended geometrical shape, preferably the shape of a rotational paraboloid. It has been an increasing demand that such antenna reflectors are not only unfoldable automatically, but that they also must be foldable again. This is necessary so that the unfolding operation can be repeated several times during the testing phase on earth. Such folding and unfolding is also necessary in order to be able to reactivate a satellite at any time.

Antenna reflectors having ribs which are foldable, that is, ribs comprising inner and outer rib sections, can be stored in an especially small space inside the transporting craft. Alternately, such antenna reflectors make it possible to deploy especially large antenna reflector surfaces. In both instances these features constitute a special advantage.

U.S. Pat. No. 4,352,113 discloses an antenna of the type mentioned above. In the known antenna inner rib sections are radially tiltable away from a central body to which the inner rib sections are journalled or pivoted and outer tiltable rib sections are connected to the radially outer end of the inner rib sections. In the folded condition all the inner rib sections are tilted upwardly toward each other and the respective outer rib sections are folded into the space formed inside the upwardly tilted inner rib sections. A motor mounted to a central body drives a spindle nut through a rotating spindle. The spindle nut is connected through rods which in turn interconnect the inner rib sections. These means make sure that the inner rib sections can be tilted out of the folded position radially outwardly into the unfolded position. In this type of structure the outer rib sections are also tilted but by a cable pull mechanism from the very start when the inner rib sections begin to tilt, so that the inner and outer rib sections reach their unfolded end position simultaneously. In this unfolding operation the inner rib sections pass through a first tilting angle of about 90° relative to the central body while the outer rib sections are being rotated relative to the corresponding inner rib sections through a second tilting angle of about 110° until the outer rib sections contact a stop. The cable pull mechanism comprises one cable for each rib. The ends of the cable are secured to the central body on the one hand and to the outer end of the outer rib section. Each pulling cable runs over a total of three cable pulleys. The tilting motion of the inner rib section makes sure automatically that the pulling cable causes a simultaneous tilting motion of the outer rib section. The return into the folded position is accomplished by springs not disclosed in further detail in U.S. Pat. No. 4,352,113.

It is a characteristic feature of the just described prior art antenna reflector and its unfolding mechanism that the outer rib sections are relatively short compared to the inner rib sections and that the unfolding of the outer rib sections begins when the unfolding of the inner rib sections begins so that the inner and outer rib sections are being tilted simultaneously. Since the outer rib sections are relatively short, they do not interfere with each other in their unfolding movement. However, such interference would take place instantly when the outer rib sections would have longer dimensions. Such longer outer rib sections would be desirable because it would result in a better utilization of the inner space formed by the upwardly tilted, inwardly folded inner rib sections and because it would provide an increased reflector surface. However, these potential advantages cannot be realized in the prior art antenna reflector because the outer rib sections are tilted simultaneously with the inner rib sections.

OBJECTS OF THE INVENTION

In view of the above it is the aim of the invention to achieve the following objects singly or in combination:

to avoid the problem of the prior art, more specifically, to provide an antenna reflector which can be folded and unfolded at any time and independently of the relative length of the outer rib sections relative to the inner rib sections;

to avoid that the outer rib sections interfer with each other during their folding or unfolding movements; and to provide locking means for locking the antenna reflector in the unfolded state, whereby such locking means must be operable for movement into an unlocked position so that the antenna reflector can be folded again at any time after a previous unfolding.

SUMMARY OF THE INVENTION

According to the invention a repeatedly foldable and unfoldable antenna reflector is characterized in that each inner rib section is arranged for cooperation with at least two cable pulleys which are also journalled about the journal axis of the respective inner rib section. A first cable pulley is coupled to the movement of the respective inner rib section throughout the entire first tilting angle range while the second cable pulley is only tiltable with the rotation or tilting of the inner rib section through a first partial tilting angle range. In a second following partial tilting angle range the second cable pulley is lockable against rotation relative to the central mounting body. Additionally, each outer rib section is coupled for rotation with a third cable pulley rotatable about the respective outer journal axis. All the first cable pulleys are drive by a motor and the second cable pulleys are connected with the third cable pulleys respectively through a closed, crossing cable loop, whereby the transmission ratio between the second and third cable pulley corresponds approximately to the ratio between the second partial tilting angle range and the second tilting angle range.

The just described structure according to the invention has the advantage that the rotation of the outer rib sections relative to the inner rib sections does not start already at the beginning of the unfolding motion. Rather, a delay is provided due to the existance of a first partial tilting angle range in which the outer rib sections still maintain their position relative to the corresponding inner rib sections. Only after the inner rib sections have been tilted through this first partial tilting angle range will the tilting motion of the outer rib sections begin. Generally, the tilting motion of the outer rib sections will have a higher angular speed than the tilting motion of the inner rib section so that both rib sections will reach their respective end position substantially simultaneously after passing through the second partial tilting angle range following the first partial tilting angle range.

The structural features which make this division of the entire first tilting angle range into two partial tilting angle ranges possible is seen in that each inner rib section is provided with two cable pulleys which are rotatable about the same journal axis as the inner rib sections, whereby such inner journal axis is secured to the central mounting body. It is important that the respective first of the two cable pulleys which is driven by the motor mouted to the central body, is coupled to the rotation of the inner rib section throughout the entire first tilting angle range so that when the first cable pulley rotates it entrains the inner rib section. It is further essential that the respective second cable pulley is coupled to the rotation of the inner rib section only in the mentioned one or first partial tilting angle range and that the second cable pulley does not participate in the rotation of the first cable pulley during the following other or second partial tilting angle range in which second partial tilting angle range the second cable pulley is locked against rotation relative to the central body. Further, it is necessary that the second cable pulleys are connected to a respective third cable pulley through an endless, crossed cable loop without any slip. The third cable pulley is rotatable about an outer journal axis located at the radially outer end of the respective inner rib section. It is also necessary that the third cable pulley is coupled to the rotation of the outer partial rib section. Due to this coupling it is assured that during the second or other partial tilting angle range the rotation of the third cable pulley caused by the cable loop also causes the respective outer partial rib section to rotate. In the one or first partial tilting angle range the third cable pulley does not yet rotate because at that time the second cable pulley is not yet decoupled from the rotation of the first cable pulley and thus also not from the rotation of the inner partial rib section. Due to the differences of all the tilting angles through which the two rib sections must pass, it is necessary that the transmission ratio between the second and third cable pulley is so selected that the outer rib sections can certainly be tilted all the way to the respective stop during the time which the inner rib sections require for passing through the second or other partial tilting angle range. Accordingly, this transmission ratio must be selected in accordance with the ratio between the second partial tilting angle range and the second tilting angle which corresponds to the relative total tilting of the individual outer rib sections.

BRIEF DESCRIPTION OF THE DRAWINGS

The invention will now be described, by way of example, with reference to the accompanying drawings, wherein:

FIG. 2*a* shows, on an enlarged scale as compared to FIG. 1, the fully folded-in position of the inner rib section with its first cable pulley;

FIG. 2*b* is a view similar to that of FIG. 2*a*, but showing the position of the fully unfolded inner rib section with its first cable pulley also in the position corresponding to the fully unfolded position of the respective rib;

FIG. 2*c* shows first and second cable pulleys view in a direction extending perpendicularly to the journal axis of these pulleys;

DETAILED DESCRIPTION OF PREFERRED EXAMPLE EMBODIMENTS AND OF THE BEST MODE OF THE INVENTION

Figure 1:
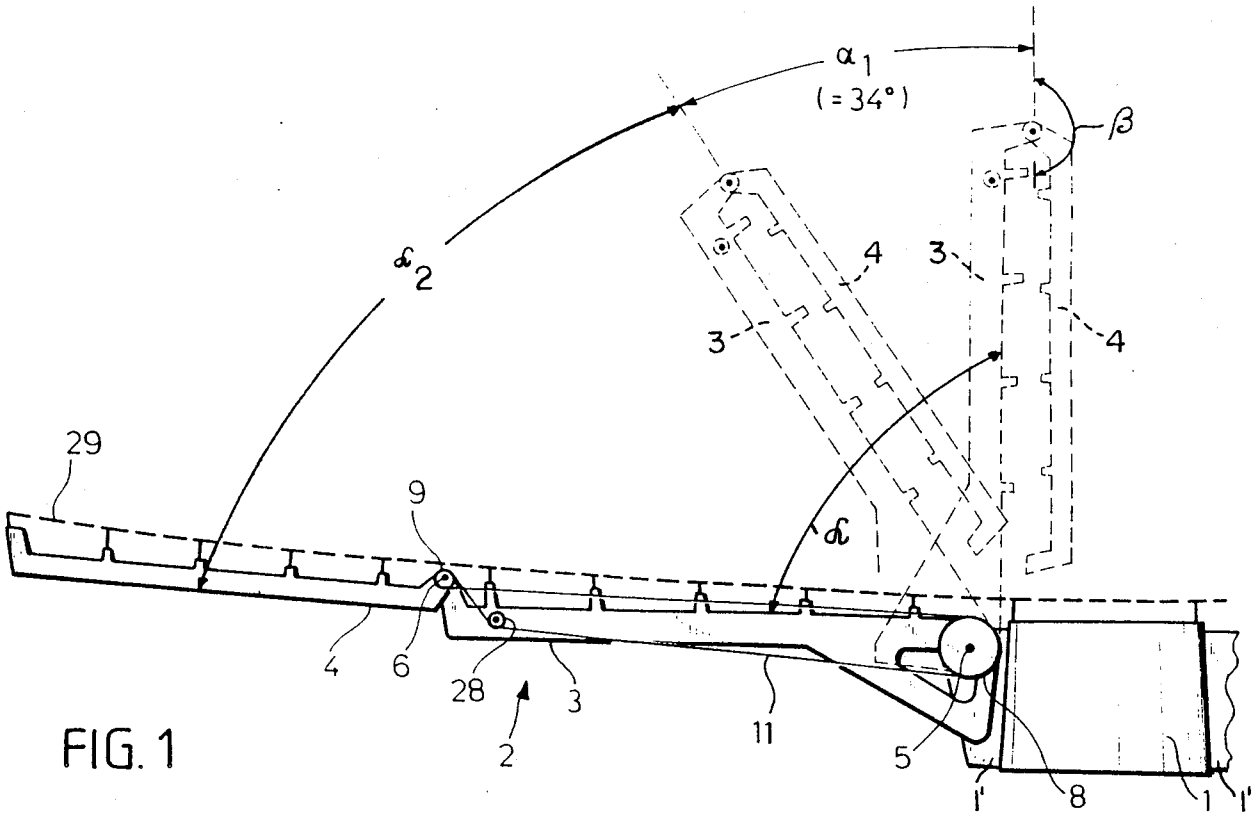
FIG. 1 shows a side view of one central mounting body and one folding rib comprising two partial ribs, namely a radially inner rib section and a radially outer rib section with the radially inner rib section journalled to the central mounting body, whereby several unfolding steps are shown in dashed lines.

FIG. 1 shows a central mounting body 1 provided with radial projections 1' to which inner journal axes 5 are rigidly secured. A folding rib 2 is journalled to the journal axis 5. The folding rib 2 comprises an inner partial rib section 3 and an outer partial rib section 4. A radially outer journal axis 6 is secured to the radially outer end of the inner rib section 3 and the outer rib section 4 is journalled to the journal axis 6. The inner journal axis 5 forming first inner journal means carries, in addition to the inner rib section 3, at least two cable pulleys including first and second cable pulleys 7 and 8 respectively, please see FIG. 2*c*. In FIG. 1 only the second cable pulley 8 is visible. A third cable pulley 9 is rotatably secured to the second outer journal means formed by the outer journal axis 6. The third cable pulley 9 is coupled in its rotation to the rotation of the outer rib section 4. An endless or closed, crossing cable loop 11 runs over the second cable pulley 8 and over the third cable pulley 9. Additionally, the loop 11 is guided by a guide roller 28. A metallic or metalized reflector net 29 shown in dashed lines in FIG. 1 is operatively secured to the rib 2.

In addition to the full line unfolded state shown in FIG. 1, there are also shown in dashed lines the fully folded condition in which the rib sections 3 and 4 extend substantially vertically and a partially unfolded state in which the inner rib section 3 has moved through a first partial tilting angle range $\alpha_1$. Up to this point a relative movement between the inner rib section 3 and the outer rib section 4 has not yet taken place. As the inner rib section 3 continues to tilt counterclockwise, a relative motion between the inner and outer rib sections takes place, also in the counterclockwise direction. One partial angular range $\alpha_1$ and the other partial angular range $\alpha_2$ depend on the dimensions of the inner and outer rib sections 3 and 4 as well as on the dimension of the central mounting body 1. In the illustrated example embodiment the first partial angular range $\alpha_1$ is about 34° and the other partial angular range is about 56°. Further, the total first tilting angle range $\alpha$ of the inner rib section 3 is approximately 90° from the vertical position to the approximately horizontal position of the rib section 3 while the second tilting angle range $\beta$ of the second rib section 4 relative to the first rib section 3 is approximately 180°.

FIG. 2*a* shows the inner rib section 3 in its folded position relative to the mounting body 1. FIG. 2*a* further shows the plan view of one of two first cable pulleys 7 which are journalled for rotation about the inner journal axis 5 rigidly secured to the projection 1' of the body 1. Both, the first cable pulleys 7 and the inner rib section 3 are rotatable about the inner or first journal axis 5. A guide pin 15 secured to the inner rib section 3 makes sure that the tilting of the inner rib section 3 and the rotation of the first cable pulley 7 about the inner journal axis 5 are coupled to each other. For this purpose the guide pin 15 reaches into a ring slot 14 in the first cable pulley 7. The ring slot 14 has an angular extension of, for example, 15° providing a respective angular play $\delta$ which is merely of significance in connection with the locking engagement of the inner rib section 3 with the central body 1.

The first cable pulley 7 can be driven by a drive cable 32 running over rollers 32' arranged in the central body 1 and onto a cable drum 40 also mounted in the central body 1. The cable drum assembly 40 comprises a motor for driving the cable drum in one or the other direction. A pull cable 13 running over a guide roller 30 is connected with one end to the first cable pulley 7 as shown at 13'. The other end of the pull cable 13 is connected to a locking bolt 12 biased by a spring 31 in a housing 33. In the position shown in FIG. 2*a* the spring 31 is compressed because the cable 13 pulls the locking bolts 12 into the housing 33. If the drive cable 32 is operated to rotate the cable pulley 7 counterclockwise, while the inner rib section 3 is still stationary, the guide pin 15 will contact the opposite end of the ring slot 14 after passing through the angular play $\delta$. Simultaneously, the connection point 13' also moves counterclockwise so that the helical spring 31 is correspondingly released for pushing the locking bolt 12 respectively out of the housing 33. Thus, the locking bolt 12 is in a position ready for assuming a locked-in position as shown in FIG. 2*b*.

If now the rotation of the first cable pulley 7 is continued in the same direction, namely counterclockwise, it will entrain the inner rib section 3 to also rotate the latter counterclockwise because the pin 15 now engages the top edge of the slot 14, whereby the inner rib section 3 also rotates counterclockwise until the position shown in FIG. 2*b* is reached. This position shown in FIG. 2*b* is the completely unfolded position in which the locking bolt 12 engages a latch member 34. For again folding the rib section 3 into the position shown in FIG. 2*a*, the first cable pulley 7 is driven by the cable 32 in the opposite or clockwise direction so that initially during the angular movement determined by the slot 14, the bolt 12 is withdrawn from the latch member 34. During this withdrawal movement the inner rib section 3 is not yet rotated until the pin 15 again engages the lower edge of the slot 14, whereupon the inner rib section 3 rotates together with the cable pulley 7 into the position shown in FIG. 2*a*.

FIG. 2*c* shows schematically the arrangement of two pairs of cable pulleys each pair comprising a first cable pulley 7 and a second cable pulley 8. The illustration corresponds approximately to a view in the direction of the arrow A in FIG. 2*a*. Both pairs of cable pulleys 7, 8 are rotatable about the inner journal axis 5 which is fixed geometrically relative to the central mounting body 1. FIG. 2*c* further shows two drive cables 32 which drive the two first cable pulleys 7. Additionally, there are shown two cable loops 11 guided by the two cable pulleys 8 to which each of the loops 11 is connected at a respective point. Two guide pins 15 engage into a respective ring slot 14 of each of the two first cable pulleys 7. These guide pins 15 actually extend through the first cable pulleys 7 and into similar ring slots in the second cable pulleys 8 as will be described in more detail below. The drive cables 32 again run over respective roller systems 32' to a motor driven cable drum 40.

Figure 3A:
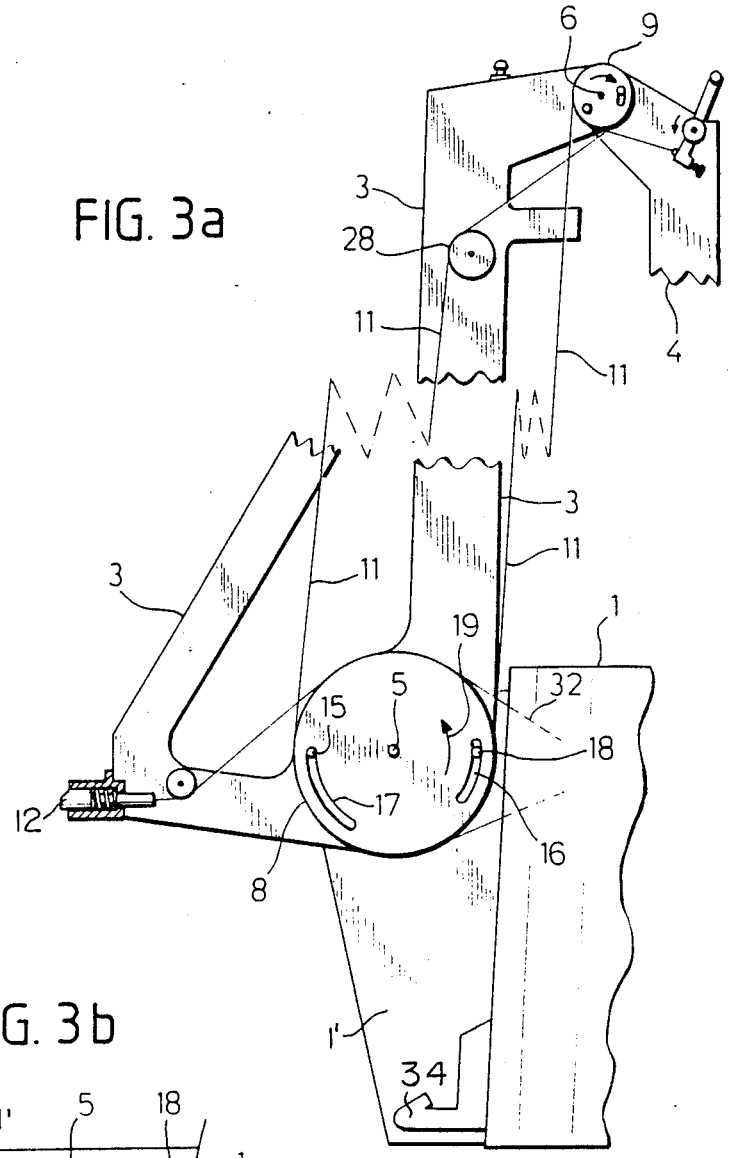
FIG. 3*a* shows a second and a third cable pulley with the respective cable loop and ribs in a substantially folded condition.
Figure 3B:
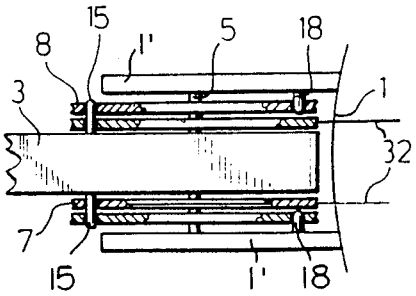
FIG. 3*b* shows the first and second cable pulleys in a sectional view extending in the same plane as the journal axis of these first and second cable pulleys.

FIG. 3*a* shows schematically the inner rib section 3 in its folded condition and equipped with first and second cable pulleys 7 and 8 as best seen in FIG. 3*b*. Only the cable pulley 8 is visible in FIG. 3*a*. The upper or radially outer end of the inner rib section 3 carries a second journal axis 6 to which a third cable pulley 9 is rotatably secured. The cable loop 11 forms an endless loop in a cross-over fashion. The cable loop 11 is connected to both cable pulleys 8 and 9 at a respective point and guided over a guide roller 28. The second cable pulley 8 is provided with a first ring slot 16 and with a second ring slot 17. An arresting pin 18 rigidly secured to the projection 1' of the central body 1 engages the ring slot 16 as best seen from FIGS. 3*a* and 3*b* taken together. The first ring slot 16 defines the above mentioned first partial tilting angle range $\alpha_1$ of, for example, 34°. The second ring slot 17 defines the above mentioned second or other partial tilting angle range $\alpha_2$ of, for example, 56°. The above mentioned guide pin 15 which is rigidly secured to the inner rib section 3 passes through the ring slot 14 in the respective first cable pulley 7 and through the ring slot 17 in the second cable pulley 8. As described above, when the drive cable 32 rotates the first cable pulley 7 counterclockwise, the guide pin 15 will assure that the inner rib section 3 is entrained after the angular play $\delta$ has been passed through, whereby the inner rib section 3 is rotated about the first or inner journal axis 5 in an unfolding radially outward direction. A torsion spring 19 indicated schematically by a respective arrow makes sure that the second cable pulley 8 is also entrained in this rotational movement, whereby the second ring slot 17 maintains the position shown in FIG. 3*a* relative to the guide pin 15. After the first partial tilting angle range $\alpha_1$ has been passed through, the second cable pulley 8 cannot continue rotating because the arresting pin 18 rigidly secured to the central body 1 now engages the opposite end of the first ring slot 16, whereby the second cable pulley 8 is arrested. As long as rotation takes place within the first partial tilting angle range $\alpha_1$, the inner rib section 3 and the first and second cable pulleys 7 and 8 rotate in unison about the inner journal axis 5 so that the cable loop 11 and thus also the third cable pulley 9 remain stationary.

Figure 3C:
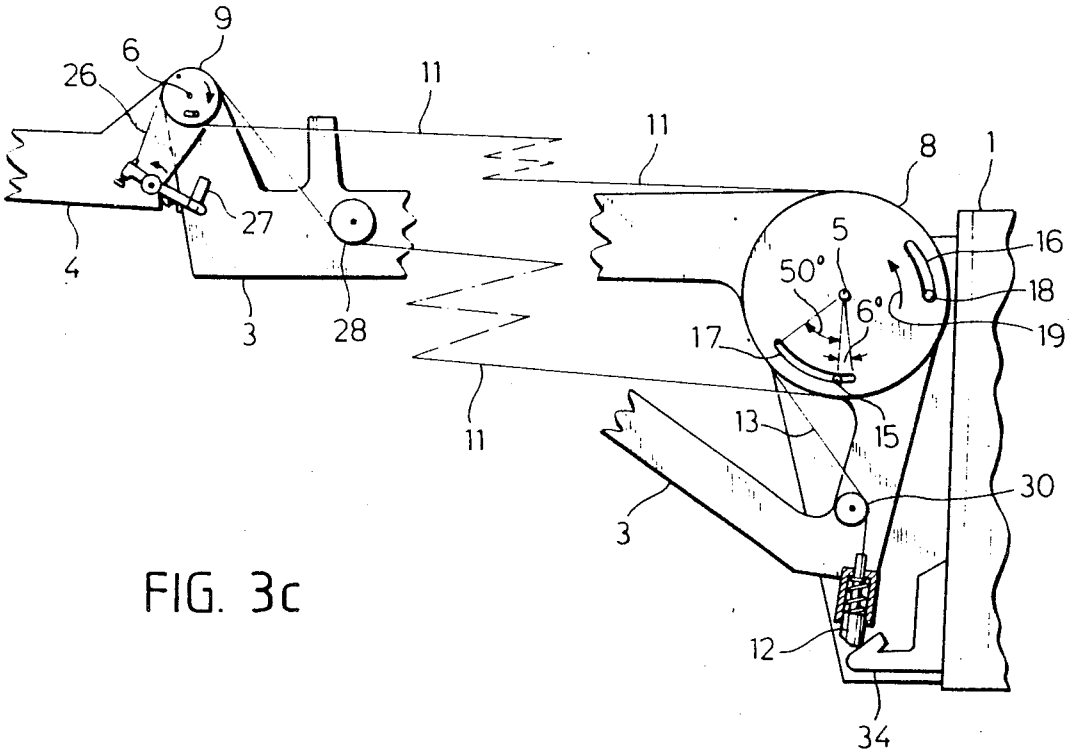
FIG. 3*c* is a view similar to that of FIG. 3*a*, but illustrating the inner and outer rib sections in an almost completely unfolded state, whereby the respective second and third cable pulleys are also shown in a rotational position corresponding to this almost completely unfolded state.

As the first cable pulley 7 continues to be rotated by a respective movement of the drive cable 32, the second cable pulley 8 is now arrested by the arresting pin 18, whereby it is decoupled from a further rotation of the first cable pulley 7 and also of the rotation of the inner rib section 3. Thus, while the second cable pulley 8 remains in the position illustrated in FIG. 3*c* relative to the arresting pin 18, the first cable pulley 7 and the inner rib section 3 continue to be tilted outwardly in the counterclockwise direction. During this time the guide pin 15 in the second ring slot 17 also travels in the counterclockwise direction. Instantly at the beginning of the second partial tilting angle range $\alpha_2$, a pull is applied to the cable loop 11. This pull causes a rotation of the third cable pulley 9 about the outer journal axis 6 also in the counterclockwise direction. This rotation of the third cable pulley 9 is possible because the second cable pulley 8 is no longer able to rotate. Due to the coupling between the third cable pulley 9 and the outer rib section 4 the latter tilts relative to the inner rib section 3 also in an outward, unfolding direction until the position shown in FIG. 3*c* is reached after passing through the second tilting angle $\beta$ of about 180° at which point the outer rib section 4 comes to a stop against the inner rib section 3. At this point the tilting through the second partial tilting angle range $\alpha_2$ of, for example, 56° is now completed to the extent of 50°, whereby all folding ribs 2 are completely unfolded. The remaining 6° of the other partial tilting angle range $\alpha_2$ serve to assure the locking engagement of the outer rib sections 4 with the inner rib sections 3. This last portion of 6° of the other partial tilting angle range $\alpha_2$ is also used for stretching out the reflector netting 29 when the folding ribs 2 are already completely stretched out so as to apply tensioning to the netting and to lock the stretched out folding ribs 2 to the central body 1 with the aid of the locking latch 34.

Figure 4A:
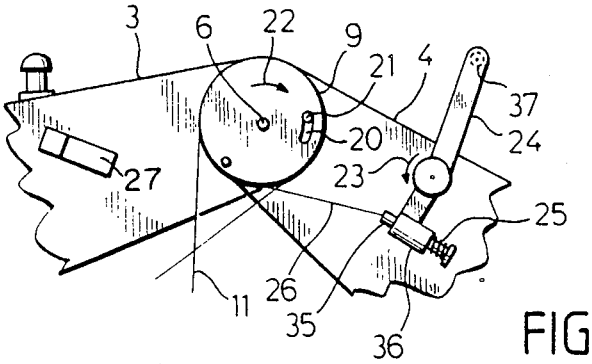
FIG. 4*a* shows the locking and journalling of the second outer rib section relative to the inner first rib section, wherein a third cable pulley is secured to the respective journal axis, and wherein the shown position represents the first or one partial tilting angle range in which the two rib sections do not move relative to each other.
Figure 4B:
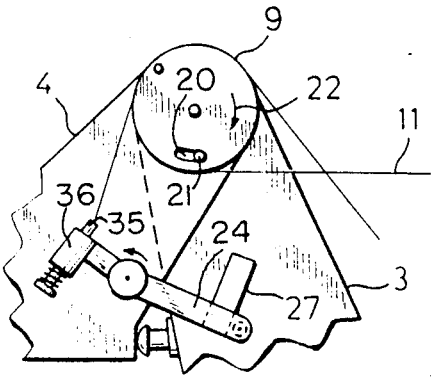
FIG. 4*b* is a view similar to FIG. 4*a*, but after the outer rib section has been rotated by about 180° relative to the inner rib section with the locking not yet fully completed.
Figure 4C:
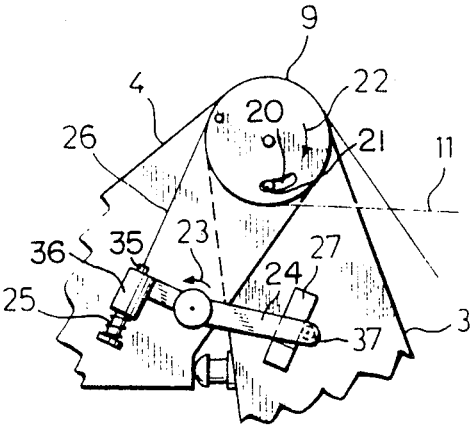
FIG. 4*c* is a view similar to FIG. 4*b* with the locking of the outer rib section relative to the inner rib section completed.

FIGS. 4*a*, 4*b*, and 4*c* illustrate three different motion phases of the interconnected components of an inner rib section 3 and an outer rib section 4 as well as the respective third cable pulley 9 and the locking mechanism. FIG. 4*a* represents the first partial tilting angle range $\alpha_1$ in which there is no relative motion between the two rib sections 3 and 4. In this condition the cable loop 11 and the third cable pulley 9 are also at rest relative to the rib sections 3, 4. The cable pulley 9 is rotatable about the second outer journal axis 6 secured to the radially outer ends of the inner rib section 3. The outer rib section 4 is coupled with the rotation of the cable pulley 9 through the ring slot 20 and a cam pin 21 engaging into the ring slot 20. The cam pin 21 is rigidly secured to the radially inner ends of the outer rib section 4. A pull cable 26 is connected to the third cable pulley 9 at one end of the pull cable 26, the other end of which is connected to a spring biased bolt 35, which is axially movable in a bushing 36 under the bias of a spring 25. The guide bushing 36 is secured to one end of a locking lever 24 which is rotatably secured to the outer rib section 4 as indicated by the arrow 23 representing a torsion spring which is loading the locking lever 24 in the unfolding direction counterclockwise. This loading or biasing by the torsion spring 23 is counteracted by a further spring 25, for example, a helical spring arranged between the end of the locking bolt 35 and the guide bushing 36. An arrow 22 represents a further strong torsional spring arranged between the third cable pulley 9 and the outer rib section 4, or rather between the cam pin 21 and the third cable pulley 9. This further strong torsion spring 22 makes sure that the cam pin 21 remains in the position shown in FIG. 4*a* relative to the ring slot 20 in the third cable pulley 9 even if the latter is rotated counterclockwise.

If now at the beginning of the second partial tilting angle range $\alpha_2$ a pull is applied to the cable loop 11 for rotating the third cable pulley 9 counterclockwise, the third cable pulley 9 and thus the outer rib section 4 begin tilting in the counterclockwise direction under the effect of the strong torsion spring 22 which causes the coupling relative to the rotational movements without any change in the position of the locking lever 24 relative to the outer rib section 4. Thus, the outer rib section 4, after travelling through a relative tilting movement of almost 180°, reaches the position illustrated in FIG. 4*b* in which the rib section 4 comes to a stop against the rib section 3. This end position also corresponds to the position shown in FIG. 3*c*. Stated differently, the second partial tilting angle range $\alpha_2$ of, for example 56° has been completed except for a remainder angle of 6°. The locking lever 24 contacts the locking latch member 27 of the inner rib section 3. However, a complete locking has not yet been achieved. The locking latch 27 may be provided with a slanted surface in the portion covered by the locking lever 24 in FIG. 4*b*. The slanted surface is followed by a recess in which the locking lever 24 is received upon further tilting in the counterclockwise direction as shown in FIG. 4*c*. The locking lever 24 may also be provided with a slide roller 37 which travels along the latch 27.

Starting with the position shown in FIG. 4*b*, a further rotation of the third cable pulley 9 causes the ring slot 20 to change its position to such an extent that the cam pin 21 now engages the opposite end of the ring slot 20 as shown in FIG. 4*c*. This relative motion takes place against the force of the torsion spring 22 because the outer rib section 4 is now in the locked position and hence cannot keep rotating. On the other hand, due to the angular play provided by the ring slot 20, the spring 25 will be released due to the yielding of the pulling cable 26 during the continued rotation of the angular play, whereby the torsion spring 23 immediately causes a follow up tilting of the locking lever 24 which is thus brought into the locking position shown in FIG. 4*c*.

The transmission ratio between the second and third cable pulleys 8 and 9 corresponds in the illustrated example to 3.6 which is equivalent to the ratio of 180:50 between the second tilting angle and the second partial tilting angle range $\alpha_2$ less the remainder angle of 6°. During the remainder angle there is no relative rotation between the two rib sections 3 and 4. Due to the transmission ratio of 3.6 and due to the remainder angle of 6° we obtain a value of 21.6° for the angle play $\gamma$ provided by the ring slot 20. Out of the 21.6°, 14.4° are used up,in the given example dimensions, for the complete locking of the locking lever 24 into the locking latch 27, as well as for the locking of the locking bolt 12 into the locking latch 34, please see FIG. 2*b*. During the remaining 7.2° corresponding to the remaining 2° of the tilting movement of the inner rib section 3, the reflector netting 29 will be fully streteched at a time when both rib sections 3 and 4 are already completely unfolded and locked relative to each other.

Another essential advantage of the described structure is seen in that only one drive mechanism requiring a relatively small mechanical expenditure is sufficient for the unfolding and locking of the antenna reflector, whereby a mere reversal of the rotational direction is sufficient for again unlocking and folding the reflector. Another advantage is seen in that the present antenna construction makes it possible to adapt the time sequence of the tilting movement and the locking and unlocking operations to the respective requirements by simply changing the diameter of the cable pulley or pulleys and by changing the angles of the ring slots. Yet another advantage is the fact, as described above, that the construction makes it possible that the reflector net is only stretched after the rib sections 3 and 4 have already been locked relative to each other so that the folding rib is stiff in itself to provide advantageous lever ratios for stretching the netting 29 into the proper position relative to the rib structure.

Although the invention has been described with reference to specific example embodiments, it will be appreciated, that it is intended, to cover all modifications and equivalents within the scope of the appended claims.

What we claim is:

1. A repeatedly unfoldable and foldable antenna reflector, comprising a central mounting body, reflector netting means, a plurality of folding ribs (2) for carrying said reflector netting means, each of said folding ribs including the following: first journal means (5) for tiltably securing said folding rib to said central mounting body (1), each folding rib having an inner rib section (3) and an outer rib section (4), second journal means (6) for tiltably securing said outer rib section to its inner rib section (3), drive means for performing a folding and unfolding operation mounted to said central body (1), said first journal means (5) being operatively secured to said central body (1) for rotation of said inner rib sections (3) through a first tilting angle range ($\alpha$), said second journal means (6) being connected to a radially outer end of said inner rib section (3) for rotation of said outer rib section (4) through a second tilting angle range ($\beta$), said drive means comprising at least two first (7) and second (8) cable pulleys arranged for operating each inner rib section (3), said two cable pulleys (7, 8) being also rotatable about said first journal means (5), first coupling means (14, 15) for coupling said first cable pulley (7) to its said inner rib section (3) for rotating through said first tilting angle range ($\alpha$), second coupling means (17, 15) for coupling said second cable pulley (8) to its said inner rib section for rotation through a first partial tilting angle range ($\alpha_1$) together with said inner rib section (3), said second coupling means locking said second cable pulley (8) to said central body (1) against rotation with its inner rib section (3) through a second partial tilting angle range ($\alpha_2$), a third cable pulley (9) journalled to said second journal means (6), third coupling means (20, 21) coupling each outer rib section (4) with the rotation of said third cable pulley (9) rotatable about said second journal means (6), said drive means driving said first cable pulley (7) and including an endless, crossing cable loop (11) for interconnecting said second (8) and third (9) cable pulleys with each other without slip, said second (8) and third (9) cable pulley having a transmission ratio corresponding approximately to the ratio between said second partial tilting angle range ($\alpha_2$) to said second tilting angle range ($\beta$).

2. The antenna reflector of claim 1, further comprising a plurality of locking means (12, 34) for arresting respective said inner rib sections (3) to said central mounting body (1), each said locking means including a spring biased locking bolt (12) secured to its said inner rib section (3) and a locking latch (34) secured to said central mounting body, and means for unlocking said spring biased locking bolt (12) from said locking latch (34).

3. The antenna reflector of claim 2, wherein each of said unlocking means comprises cable pull means (13) for connecting said first cable pulleys (7) with said spring biased locking bolt (12) of its said inner rib section (3), said first cable pulley (7) having an angular play ($\delta$) about said first journal means (5), said angular play corresponding to a locking or unlocking displacement of said spring biased locking bolt (12) by said unlocking means.

4. The antenna reflector of claim 3, wherein said first coupling means comprise a ring slot (14) in said first cable pulley (7), said ring slot (14) extending over an angular range corresponding to said angular play ($\delta$), said first coupling means further comprising a guide pin (15) secured to the respective inner rib section (3) extending into said ring slot (14).

5. The antenna reflector of claim 4, wherein said second coupling means comprise a first ring slot (16) in said second cable pulley (8), each first ring slot (16) extending over an angular range corresponding to said first partial tilting angle range ($\alpha_1$) and a second ring slot (17) extending over an angular range corresponding to said second partial tilting angle range ($\alpha_2$), said second coupling means further including an arresting pin (18) secured to said central mounting body (1) for engaging in said first ring slot (16), wherein said guide pin (15) engages in said second ring slot (17), and torsion spring means (19) connected to said second cable pulley (8) for urging said second cable pulley in an unfolding direction.

6. The antenna reflector of claim 1, wherein said third coupling means comprise a ring slot (20) in said third cable pulleys (9), and a cam pin (21) connected to said outer rib section (4), said cam pin (21) engaging in said ring slot (20), and torsion spring means (22) biasing said outer rib sections (4), relative to said third cable pulley (9), in an unfolding direction.

7. The antenna reflector of claim 6, wherein each of said outer rib sections (4) comprises a tiltable locking pawl lever (24), torsion spring means (23) for biasing said locking pawl lever (24) in an unfolding direction a pawl latch member (27) cooperating with said locking pawl lever (24), said pawl latch member (27) being secured to said inner rib section (3), and pull cable means (26) connecting said locking pawl lever (24) to said third cable pulley (9) for unlocking said locking pawl lever (24).

* * * * *